US011214068B2

(12) United States Patent
Cabello Cabrera et al.

(10) Patent No.: US 11,214,068 B2
(45) Date of Patent: Jan. 4, 2022

(54) PRINTHEAD SERVICING

(71) Applicant: HEWLETT-PACKARD DEVELOPMENT COMPANY, L.P., Spring, TX (US)

(72) Inventors: Sheila Cabello Cabrera, Sant Cugat del Valles (ES); Mauricio Seras Franzoso, Sant Cugat del Valles (ES); Andreu Cortes Vicens, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/491,864

(22) PCT Filed: Apr. 30, 2018

(86) PCT No.: PCT/US2018/030119

§ 371 (c)(1),
(2) Date: Sep. 6, 2019

(87) PCT Pub. No.: WO2019/212464

PCT Pub. Date: Nov. 7, 2019

(65) Prior Publication Data

US 2021/0331479 A1 Oct. 28, 2021

(51) Int. Cl.
*B41J 2/165* (2006.01)

(52) U.S. Cl.
CPC ..... *B41J 2/16535* (2013.01); *B41J 2/16538* (2013.01); *B41J 2/16544* (2013.01); *B41J 2002/1655* (2013.01); *B41J 2002/1657* (2013.01); *B41J 2002/16576* (2013.01); *B41J 2002/16582* (2013.01)

(58) Field of Classification Search
CPC ..... B41J 2/16511; B41J 2/16544
See application file for complete search history.

(56) References Cited

U.S. PATENT DOCUMENTS 5,103,244 A * 4/1992 Gast ..... B41J 2/16544 347/33
5,155,497 A * 10/1992 Martin ..... B41J 2/1652 347/33

(Continued)

FOREIGN PATENT DOCUMENTS

DE 10133550 A1 * 1/2002 ..... B41J 2/16544
EP 0719645 A2 * 7/1996 ..... B41J 2/16511

(Continued)

*Primary Examiner* — Julian D Huffman
(74) *Attorney, Agent, or Firm* — HP Inc. Patent Department

(57) ABSTRACT

There is provided a maintenance apparatus to, while in a service zone, perform a cleaning operation of a set of printheads within a carriage. The maintenance apparatus comprises a cleaning structure and an actuation mechanism. The actuation mechanism is arranged to position the cleaning structure between an engaged configuration and a disengaged configuration. The disengaged configuration is activated by a first triggering element associated to the carriage interacting with the actuation mechanism subsequent to a cleaning operation. The engaged configuration is activated by a second triggering element as the carriage moves away from the service zone.

15 Claims, 7 Drawing Sheets

(56) References Cited

U.S. PATENT DOCUMENTS

| | | | | |
|---|---|---|---|---|
| 5,396,277 | A | 3/1995 | Gast et al. | |
| 5,644,347 | A * | 7/1997 | Schwiebert | B41J 2/16511 347/24 |
| 5,663,751 | A * | 9/1997 | Holbrook | B41J 2/16544 347/22 |
| 5,733,055 | A * | 3/1998 | Hiramatsu | B41J 2/16511 347/29 |
| 5,793,391 | A * | 8/1998 | Kawakami | B41J 2/16544 347/33 |
| 5,914,734 | A | 6/1999 | Rotering et al. | |
| 6,151,044 | A | 11/2000 | Gaasch | |
| 6,172,691 | B1 | 1/2001 | Belon et al. | |
| 6,416,161 | B1 | 7/2002 | Berg et al. | |
| 6,802,590 | B2 | 10/2004 | Lim | |
| 6,916,080 | B2 | 7/2005 | Okamoto | |
| 7,722,155 | B2 | 5/2010 | Takahashi et al. | |
| 9,862,194 | B2 | 1/2018 | Llado et al. | |
| 10,513,120 | B1 * | 12/2019 | Ou | B08B 17/025 |
| 11,072,178 | B1 * | 7/2021 | Kailey | B41J 2/16526 |
| 2001/0002838 | A1 * | 6/2001 | Nakahara | B41J 2/16532 347/30 |
| 2004/0012650 | A1 | 1/2004 | Thiessen et al. | |
| 2006/0209152 | A1 | 9/2006 | Baringa et al. | |
| 2013/0025391 | A1 * | 1/2013 | Magnusson | B41J 11/42 74/409 |
| 2013/0044159 | A1 * | 2/2013 | Hamano | B41J 2/16535 347/33 |
| 2013/0050335 | A1 * | 2/2013 | Tanaka | B41J 2/16511 347/32 |
| 2016/0075139 | A1 * | 3/2016 | Okushima | B41J 2/2146 347/35 |
| 2020/0254766 | A1 * | 8/2020 | Hoover | B41J 2/16508 |
| 2021/0146688 | A1 * | 5/2021 | Qian | B41J 2/16508 |
| 2021/0170750 | A1 * | 6/2021 | Jariabka | B41J 29/38 |

FOREIGN PATENT DOCUMENTS

| | | | | |
|---|---|---|---|---|
| EP | 0788884 | B1 * | 11/1999 | B41J 2/16511 |
| EP | 3107736 | A1 | 12/2016 | |
| KR | 100333216 | B1 * | 9/2002 | B41J 2/16511 |
| WO | WO-2019245537 | A1 * | 12/2019 | B41J 2/16508 |
| WO | WO-2020055302 | A1 * | 3/2020 | D06B 11/0023 |

* cited by examiner

PRINTHEAD SERVICING

BACKGROUND

Printheads can be serviced to help maintain clean nozzles for printing. Moveable wipers can be used to clean the printheads, where the wipers can be moved between two positions. For example, the wipers can extend when the printhead comes near to the wiper for cleaning and retract when the printhead moves away. A spitting operation with a spittoon can clear the nozzles after servicing ready for the next rendering fluid drop to be fired. Without servicing some printheads may become blocked. Printhead servicing helps to achieve an acceptable printed image quality.

BRIEF DESCRIPTION OF THE DRAWINGS

Various features and advantages of certain examples will be apparent from the detailed description which follows, taken in conjunction with the accompanying drawings, which together illustrate, by way of example only, a number of features, and wherein.

DETAILED DESCRIPTION

Figures 1A, 1B:
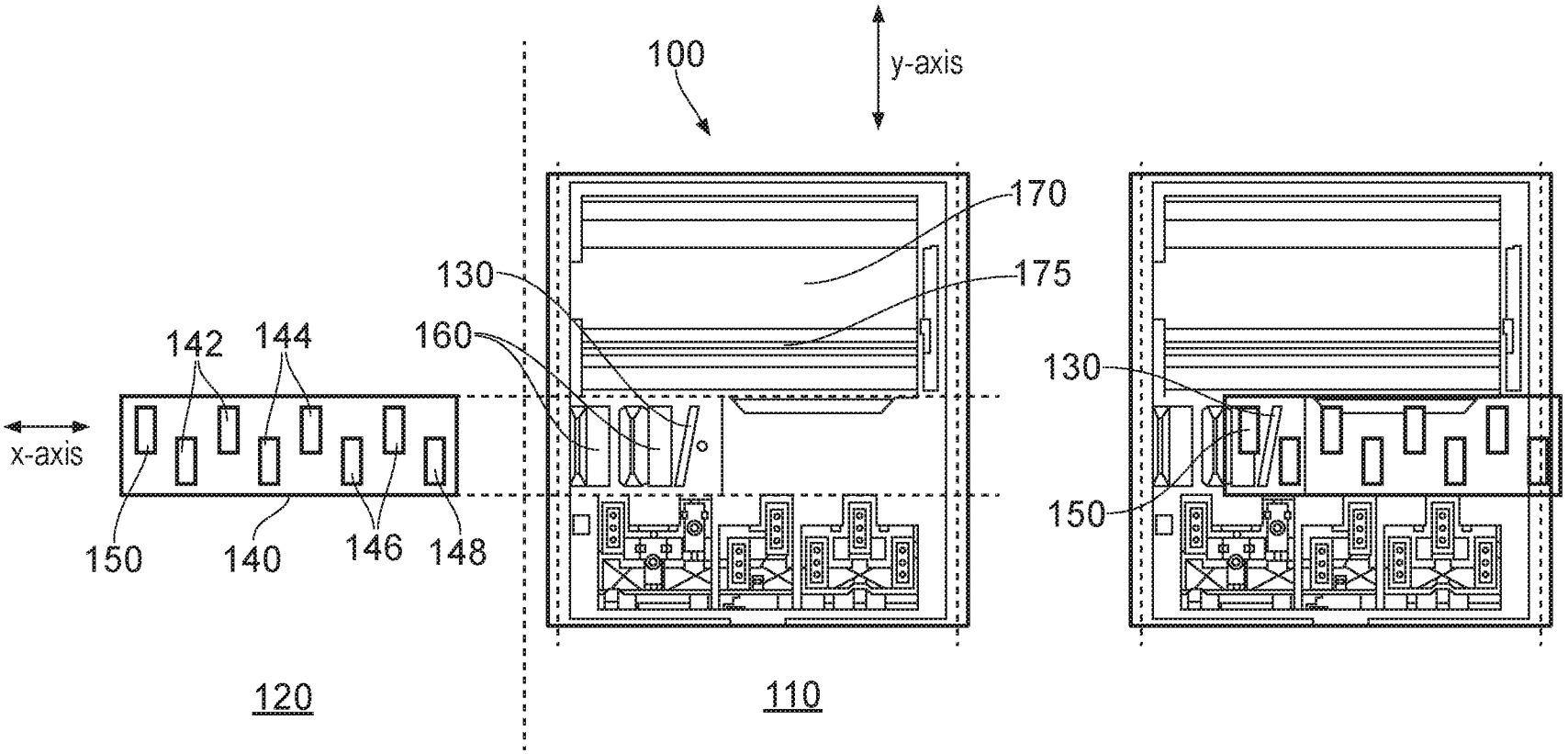
FIGS. 1A and 1B show a cleaning apparatus with a servicing workflow for a cross wipe pass according to an example.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

A cleaning mechanism for cleaning a printhead is disclosed. The cleaning mechanism may comprise a wiper. The cleaning mechanism can be synchronised with a carriage movement, where the term synchronised is used to relate to the printhead carriage movement actuating the cleaning mechanism or a cleaning operation.

A print carriage can carry many cartridges each having a printhead. The carriage may comprise a first set of printheads and a second set of printheads. The cartridges for the first set of printheads may each carry a different rendering fluid. According to an example the first set of printheads comprise a marking fluid, e.g., cyan, magenta, yellow, black, light cyan, light magenta, light yellow. The cartridges for the second set of printheads may include an enhancer fluid. According to an example an enhancer fluid comprises an optimiser or pre-treatment and/or overcoat. An optimiser or pre-treatment fluid is used to fix fluid from the first set of printheads to a print target or substrate. An overcoat may comprise latex and/or wax. According to an example, the rendering fluid comprises latex. The latex based rendering fluid may have properties with improved durability and resistance to being scratched.

The cleaning mechanism may be provided within a maintenance cartridge. According to an example, a maintenance cartridge is a consumable unit that can integrate hardware for servicing printheads. The maintenance cartridge can manage waste generated during the servicing of the printheads.

A cross wiper may be provided in the maintenance cartridge. According to an example, the cross wiper comprises a flexible wiper that can be used in passes of the printhead. For example, the flexible wiper comprises rubber. During printing, the nozzle plate of the printhead can accumulate a puddling. The cross wiper is configured to prevent puddling from accumulating in the nozzle plate by performing a wiping action to clean the printhead surface.

Within a rendering apparatus, a print zone may be determined as a region or area in which a printhead is able to print, and a service zone may be determined as a region or area in which one or more printheads are serviced or maintained. The maintenance cartridge or service module can be located in the service zone. The service zone may be position at the side of the print apparatus.

According to an example, the cleaning mechanism is used in an inkjet 2D or 3D printer. In a further example, the cleaning mechanism is used in a thermal inkjet printer. Furthermore, the printer may use products comprising latex as rendering fluid. Rendering fluids that comprise latex cure with temperature and thermal inkjet printheads apply heat to fire drops. In this environment if the printheads are not adequately serviced the rendering fluid can cure on the nozzle plate due to the heat, also known as crusting. If this happens the nozzles can become blocked which can lead to print quality defects. To prevent crusting excessive heat on the printheads may be avoided and/or the puddling that accumulates on the nozzle plate while printing may be cleaned. A cleaning operation can comprise wiping a puddling of rendering fluid accumulated on the printhead nozzle plate.

In addition, or alternatively to the cross wiper, a web wiper may be provided in the maintenance cartridge. Whereas the cross wiper may comprise an elastomeric material, e.g., a flexible, or rubber material, the web wiper comprises an absorbent material, for example, a woven or foam material and, in a further example, a rubber part.

According to an example, a web wiping pass comprises cleaning the puddling accumulated in the printhead surface with the web wiper that is pressed towards the printhead, e.g., with a rubber part or blade running underneath the absorbent material. Use of a flexible wiper with the absorbent material, such as rubber, helps to achieve an acceptable force that is applied to the nozzle during the cleaning operation. The web wiper reduces the amount of puddling that may be pushed into the nozzles to an adequate level. The nozzles may perform a spitting operation straight after the web wipe pass to prevent print defects due to a lack of rendering fluid being fired from the nozzle on the next immediate firing sequence.

According to an example, the printheads may comprise a firing frequency between 4 kHz and 9 kHz. In this way, print defects, such as streakiness, does not appear in the rendered image on the print target. For example, streakiness may appear in areas of the print target where the printheads do not adequately fire drops, which may occur at the edge of the print target immediately after wipe operations.

A print direction can be defined along an x-axis. For example, the carriage carrying the printheads can move along the print direction in the x-direction. The carriage can move in the print zone whilst rendering or printing an image onto a print target.

According to an example, the maintenance cartridge can be located in a service zone which may be adjacent the print zone. For example, the maintenance cartridge or service station may be located at the side of a rendering or printing apparatus.

According to an example, a y-axis can be defined as being perpendicular to the printing x-axis, where the maintenance cartridge can move along the y-axis.

According to an example, a cross wiper and a web wiper are not axially aligned in the maintenance cartridge along the x-direction. For example, the cross wiper may be disposed a distance from the web wiper along the y-axis. If a cross wiper and web wiper are being performed in the same service operation, the maintenance cartridge may move along the y-axis between the cross wiper and web wiper actions to reposition the printheads accordingly. According to an example, the printheads are cross wiped and the maintenance cartridge moves along the y-axis to perform a web wipe pass and align the printheads above the web thereby allowing the printheads to spit on the web before the carriage exits the service zone, i.e. the web wiping action takes place during the maintenance cartridge movement.

According to an example, once the carriage has exited the service zone, the maintenance cartridge moves along the y-axis to align the cross wiper with the printheads moving along the x-direction. This movement of aligning the cross wiper with the printheads after the web wipe pass is performed to ready the maintenance cartridge for the next cross wipe pass or cross wipe action.

According to an example, the cleaning structure is a cross wiper which may comprise an elastomeric blade.

An example servicing workflow for a cross wipe pass will now be described with reference to FIG. 1A. The maintenance cartridge 100 or service station may be located in a service zone 110. The service zone may be adjacent a print zone 120. The maintenance cartridge can move along the y-axis to align the cross wiper 130 with printheads in a carriage. The carriage carrying color printheads 142, 144, 146, 148, and enhancer printheads 150 that can pass from the print zone into the service zone along the x-axis. The printheads may correspond to cyan 142, magenta 144, yellow 146, black 148 and the enhancer printheads 150 may comprise pigments, pre-treatment fluids, optimisers, and/or any other non-marking fluids. The carriage 140 can enter the maintenance cartridge and as it passes the cross wiper the printheads are wiped.

As shown in FIG. 1B, the carriage can stop once all printheads, except an optimiser or pre-treatment printhead 150, have been cross wiped. The carriage can stop in a specific position such that the pre-treatment printhead is not wiped. This avoids cross-contamination between some of the printheads, in this case, between the enhancer printheads 150 and the color printheads 142, 144, 146, 148. An optimizer fluid can be used to fix pigments to a print target. For example, if the enhancer printhead 150 comprising an optimizer were to contaminate color printheads, the optimizer fluid could react with the color rendering fluid and the nozzles could get clogged. The solution disclosed for servicing or maintaining the color printhead surfaces prevents the optimizer printhead from coming into physical contact with the cross wiper. The carriage may then move from the service zone or from the maintenance cartridge to the print zone.

To avoid the accumulation of puddling, a cleaning routine can be performed frequently in the color printheads or printheads carrying pigmented fluid.

During a wiping operation, some of the puddling can be pushed into the nozzles, preventing the nozzles from firing the first drops to be printed after the wipe. According to an example, after printheads have been cross wiped, the printheads may perform a spitting operation. Therefore, the maintenance apparatus may further comprise a spittoon. The printheads may spit on the spittoon. A spittoon may comprise hardware for receiving and storing the spitting. According to an example, the spittoon may comprise one or more rollers 160 or a web 170.

Figures 2A, 2B, 2C:
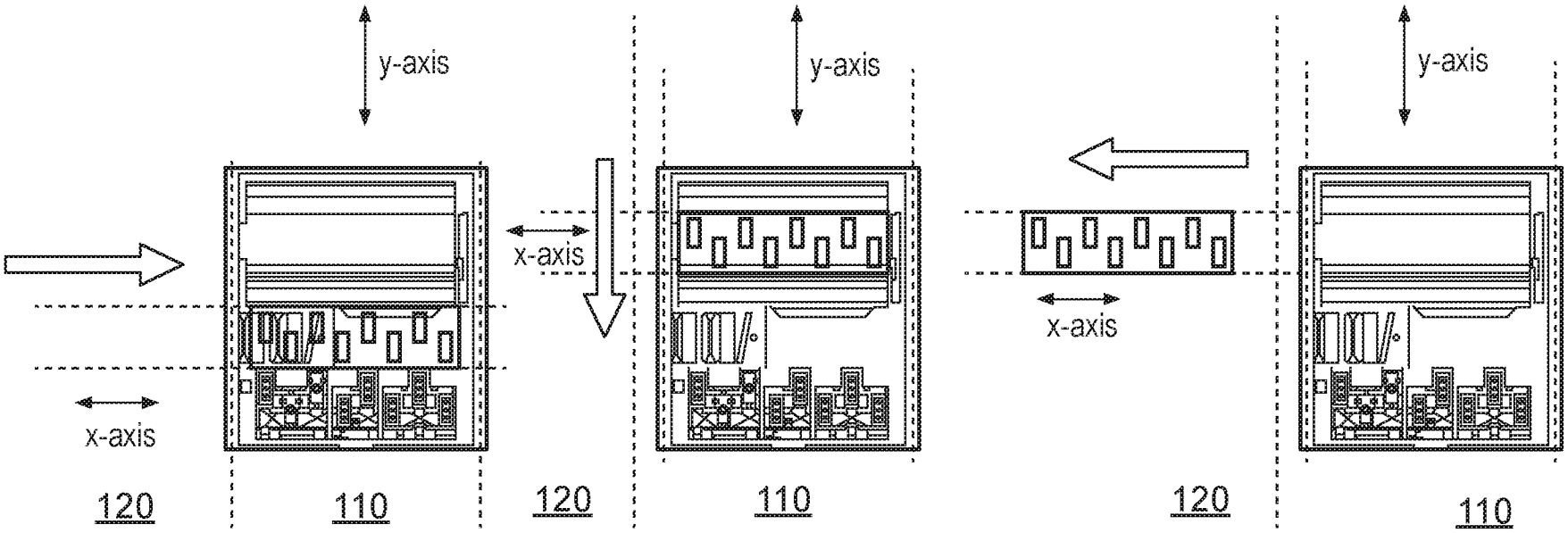
FIGS. 2A-2C show a servicing workflow for a web wipe pass according to an example.

An example servicing workflow for a web wipe pass will now be described. According to an example, a web wipe action can take place in a ratio of one web wipe pass to every eleven cross wipe passes. The ratio of web wiping to cross wiping may depend upon a temperature of the nozzles in the printheads. The carriage may pass from the print zone to the service zone, where the maintenance cartridge or service station is located in the service zone. The carriage carrying the printheads can pass from the print zone into the service zone along the x-axis. The carriage may enter the maintenance cartridge with the cross-wiper aligned with the printheads so as to perform a cross wiping action as shown in FIG. 2A. As shown in FIG. 2B, the maintenance cartridge can subsequently move along the y-axis to wipe the printheads with the web wiper 175. Alternatively, the carriage may enter the maintenance cartridge with the web-wiper aligned with the printheads so as to perform a web wiping action. The maintenance cartridge can subsequently move along the y-axis to align the printheads with the cross wiper. As shown in FIG. 2C, the carriage may then move from the service zone or from the maintenance cartridge to the print zone.

According to an example, with the printheads positioned above the web, as shown in FIG. 2B, the printheads can perform a spitting operation on the web.

An example servicing workflow for a spitting operation will now be described. The carriage may enter the maintenance cartridge with the web aligned with the printheads. The printheads can perform a spitting operation on the web. The carriage may then move from the service zone or from the maintenance cartridge to the print zone.

According to an example, after the carriage moves from the service zone or from the maintenance cartridge into the print zone, the maintenance cartridge may align the cross wiper with the printheads ready for a subsequent cross wipe pass. The maintenance cartridge may move along the y-axis to align the cross wiper with the printheads or carriage moving along the x-axis.

According to an example, when a cleaning action is performed a spitting operation subsequently follows in which rendering fluid is spit from the printheads before printing the next pass. A spitting operation may be performed where the first drops to be fired subsequent to a cleaning action are a mix of pigments or colors. After a web wipe pass the printheads may spit on the spittoon or web. According to an example, a spittoon is provided adjacent the cross wiper, i.e. the spittoon is positioned a distance along the x-axis from the cross wiper. The configuration of the spittoon and cross wiper within the maintenance cartridge with respect to the carriage can affect print throughput, printer width, and/or cross contamination of a pre-treatment cartridge.

According to an example, the cross wiper and web spittoon are axially aligned in the maintenance cartridge along the x-direction.

Figure 3B:
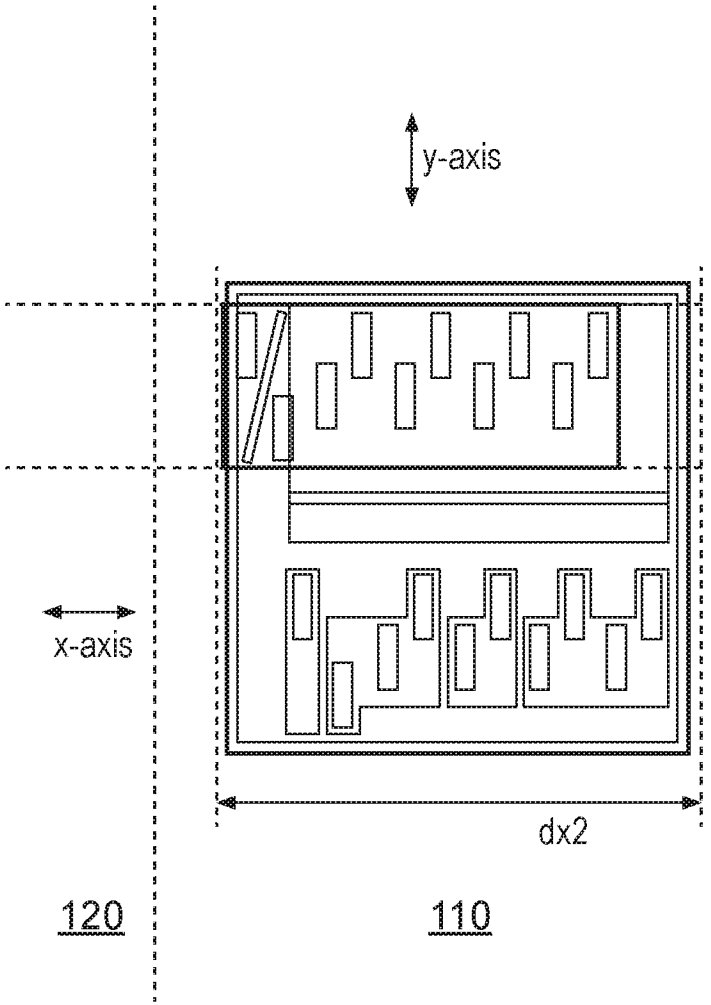
FIGS. 3A and 3B show a cleaning apparatus comprising a spittoon according to an example.
Figure 3A:
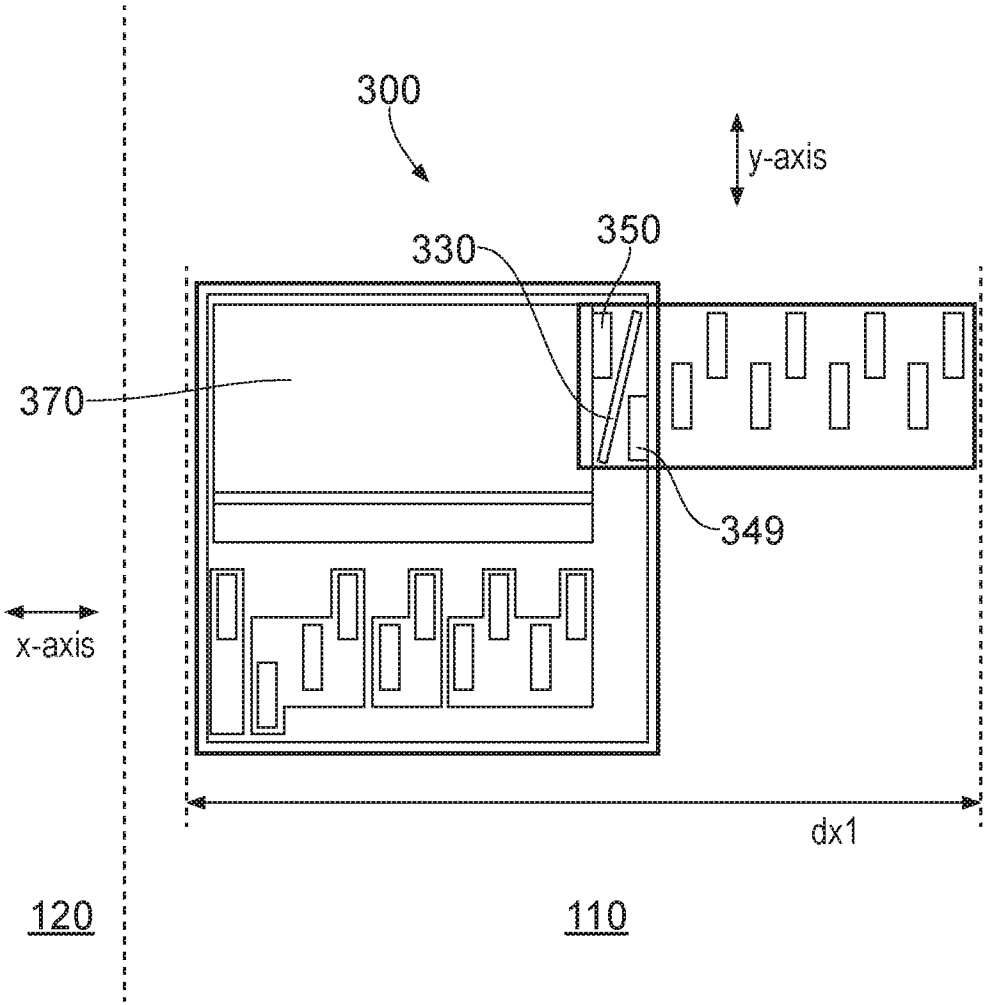

FIG. 3A shows a spittoon 370 adjacent the cross wiper 330 according to an example. A carriage moving in the print zone 120 can enter the service zone 110 for printhead servicing. The cross wiper is shown located on a distal side of the spittoon from the carriage (i.e. to the right-hand-side of the spittoon as shown). The service station width, dx1, of FIG. 3A is approximately double the width of the carriage. After the printheads have been cross wiped the carriage can be positioned above the spittoon allowing the printheads to perform a spitting operation. All or some of the printheads may be cross-wiped. In an example, the cross-wiper may be disengaged so that some printheads, such as enhancement printheads 350, are not cross wiped. The term disengaged relates to the cross wiper not contacting the printheads. The carriage may comprise an overcoat or finisher printhead 349. The maintenance cartridge can remain in the same position along the y-axis for the cross wiping and spitting operation and for the carriage to move to the print zone. FIG. 3A shows a configuration wherein after a cross wipe pass the maintenance cartridge can remain in the same position allowing the printheads to translate along the x-axis to the spittoon to perform a spitting operation and subsequently move to the print zone.

FIG. 3B shows a spittoon adjacent the cross wiper according to an example. A carriage moving in the print zone 120 can enter the service zone 110 for printhead servicing. The cross wiper is shown located on a near side of the spittoon to the carriage (i.e. to the left-hand-side of the spittoon as shown). The service station width, dx2, of FIG. 3B is approximately the same as that of the width of the carriage. After the printheads have been cross wiped the printheads are positioned above the spittoon allowing the printheads to perform a spitting operation. After the spitting operation the maintenance cartridge may move or translate along the y-axis thereby removing the cross wiper from the travel path of the carriage along the x-axis when it moves to the print zone. Alternatively, a triggering mechanism can be provided to disengage the cross wiper after the cross wiping operation and allowing the maintenance cartridge to remain in the same position along the y-axis for the cross wiping and spitting operation and for the carriage to move to the print zone. The configuration shown in FIG. 3B provides a more compact servicing or cleaning apparatus and thereby minimises the width of the rendering apparatus.

According to an example, the spitted rendering fluid is accumulated in the spittoon. The spitted rendering fluid may be stored until it reaches a saturation point. The saturation point may be defined where spitted rendering fluid meets a printhead surface. According to an example, the spittoon may remove spitted rendering fluid from the position of the printhead for a subsequent spitting operation. According to an example, the spittoon is a spit roller 160 that may rotate such that the rendering fluid is spitted onto the roller and removed using a scraper in contact with the rotating roller. As such, the waste is removed in situ or removed continuously to prevent the rendering fluid from accumulating, for example to a saturation point. This provides for a more efficient spitting operation. According to an example, the spittoon is a web 170 where rendering fluid from the printheads is spitted on the web (which may perform a web wipe pass). The web may advance with spitting use such that it prevents the rendering fluid from accumulating, for example to a saturation point.

According to an example, when a spittoon surface is separated from a printhead surface in order to prevent the build up to reach the printheads, aerosol is generated. The closer the spittoon is to the printhead, the less aerosol is generated. For example, during a spitting operation, pigments in the fluid spitted may evaporate and the remaining fluid may enter the spittoon. The evaporation ratio increases when the ambient temperature is comparatively higher and the humidity is comparatively lower. When the evaporation ratio is larger for the pigment compared to the remaining fluid, the waste can be more viscous or stickier. According to an example the web may be advanced around a roller using a motor in between spitting operations to provide a new section of web to help reduce clogging of the waste in the spittoon and/or to extend the longevity of the web and/or rollers.

In situations where a rendering fluid comprising latex is used, a web may be provided instead of a spit roller. Latex based rendering fluids may possess a different viscosity behavior compared to the waste from other fluids. For example, rendering fluid comprising latex may be more viscous (or stickier) than rendering fluids not comprising latex. For a more viscous waste rendering fluid, such as those comprising latex, an advancing web may be provided instead of a scraper roller. A web may be provided where the web may continually advance during a spitting operation such that the waste spitted does not build up to a saturation point.

According to an example, a spit image which is larger than the rendering image is used to control the amount of spitting from each printhead. For example, the size of the image spitted may be inversely proportional to the percentage of rendering fluid evaporated (i.e. the smaller the image spitted, the bigger the percentage of fluid evaporated). The amount of rendering fluid used for the spitting operation may be linked to the ambient temperature and humidity using an intelligent algorithm in order to minimize the effect in cost per copy.

According to an example, there is provided a printhead cleaning mechanism that is triggered by the carriage movement. For example, the movement of the printhead cleaning mechanism may be synchronized with carriage movement. A trigger element may be provided to position the cross wiper in an engaged position or a disengaged position where the cross wiper passes through an intermediate position between the engaged and disengaged positions, i.e. the cross wiper may be described as a bi-stable mechanism.

According to an example, the disengaged configuration may be activated by a first triggering element. The first triggering element may comprise a projection on a printhead or carriage. For example, the projection may be provided on an under-carriage protector. The under-carriage protector may be located on a lower surface of the carriage such that when the carriage enters the service zone the lower surface is adjacent the cross wiper and/or web wiper. A corresponding projection may be provided on the maintenance cartridge such that both projections interact.

According to an example, the engaged configuration may be activated by a second triggering element. The second triggering element may comprise a motor within the maintenance cartridge.

An engaged or deployed position corresponds to the cross wiper being extended such that the printheads can pass and contact the cross wiper to perform a cleaning operation. A disengaged or stowed position corresponds to the cross wiper being retracted such that the printheads can pass but not contact the cross wiper such that a cleaning operation is not performed. An intermediate position corresponds to the cross wiper being at a position in between the engaged and disengaged positions, for example when the cross wiper is transitioning between the engaged and disengaged positions. The engaged and disengaged positions may be seen as discrete configurations.

A maintenance cartridge or maintenance apparatus is provided to perform a cleaning operation of a set of printheads within a carriage. The maintenance cartridge comprises a cleaning structure, such as a cross wiper, and an actuation mechanism. The actuation mechanism is configured to position the cleaning structure between an engaged configuration and a disengaged configuration. The disengaged configuration may be activated by a first triggering element associated to the carriage subsequent to a cleaning operation. For example, the first triggering element may be a projection on a printhead within the carriage. The engaged configuration may be activated by a second triggering element when the carriage moves away from a service zone. For example, the second triggering element may be a motor located within the maintenance cartridge, which may perform the function of a web-advancement motor.

According to an example, a first triggering element is provided as one or more projections in the contact surface between the printhead and the wiper. The triggering element may be located on an under-carriage-protector. A corresponding first triggering element on the maintenance cartridge may be provided to interact with the projection on the printhead or under-carriage protector. The corresponding first triggering element on the maintenance cartridge may be a projection located on a distal end of a lever of the cleaning mechanism.

Figures 4A, 4B, 4C:
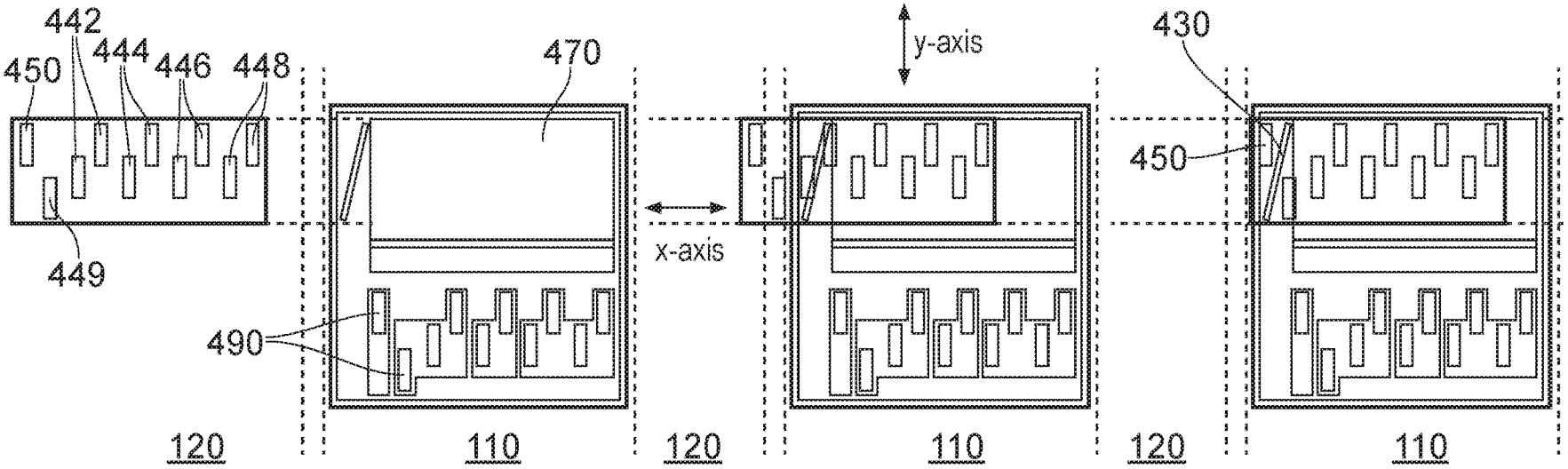
FIGS. 4A-4F show a servicing workflow for a cross wipe pass according to an example.

An example servicing workflow for a cross wipe pass with carriage movement will now be described. According to an example, the cross wipe retracts once the cross wipe action has been finished. According to an example, a movable cross wiper 430 may be provided that comprises a trigger element (e.g. a projection on a lever). As shown in FIG. 4A, the carriage can move from the print zone and enter into the service zone. As the carriage moves into the maintenance cartridge the printheads are wiped by the cross wiper 430. The carriage may enter the maintenance cartridge along the x-direction. As the carriage enters the maintenance cartridge the printheads are wiped by the cross wiper. The first set of printheads which may comprise pigments 442, 444, 446 can be wiped, including an overcoat printhead 449, but the pre-treatment printhead 450 is not wiped. As shown in FIG. 4B, seven out of the nine printheads shown have been wiped by the cross wiper.

Figure 4F:
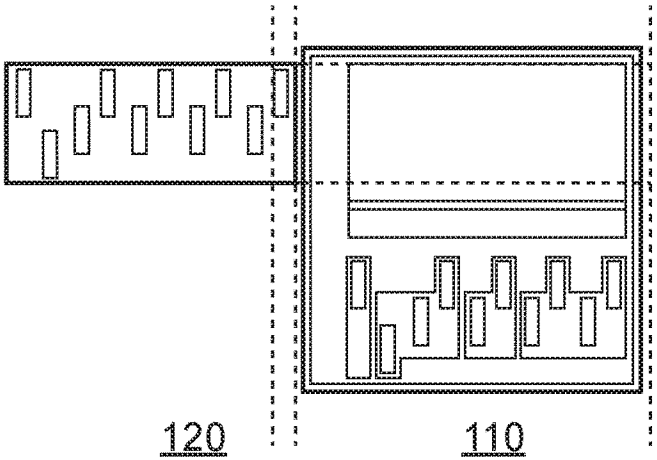

At a predetermined position, as shown in FIG. 4C, the carriage movement may trigger the cross wiper to disengage such that the pre-treatment cartridge 450 does not pass over the cross wiper 430. The carriage movement triggers the cross wiper to disengage (i.e. retract/get down) when all of the printheads but the pre-treatment/optimizer printhead have been cross wiped. For example, the cross wiper may be triggered to disengage in the exact moment that the pre-treatment printhead comes in close proximity to the cross wiper, as shown in FIG. 4D. The triggering mechanism may cause the cross wiper to disengage extremely quickly to allow a higher printing throughput, i.e. the disengage speed is faster than the time taken for the pre-treatment printhead to reach the cross wiper after the previous printhead has been wiped, such that as the carriage keeps traveling passed the cross wiper, the cross wiper has already disengaged by the time the pre-treatment printhead passes the cross wiper position. According to an example, the movement of engaging the cross wiper again is performed quickly, i.e. before the carriage comes back to the service zone, to help ensure an adequate printer throughput.

Figure 4E:
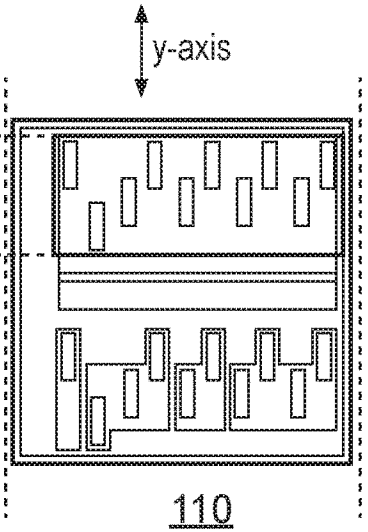
Figure 4D:
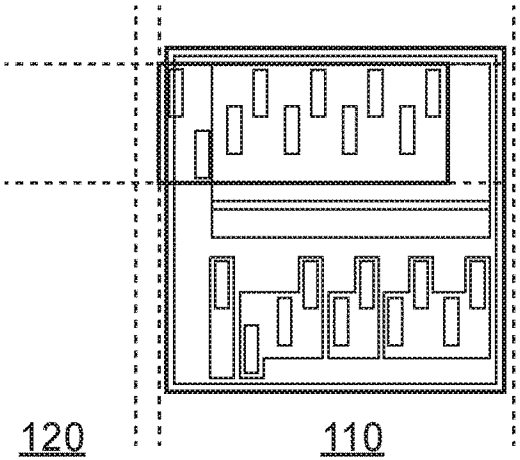

As shown in FIG. 4E the carriage continues to travel to the maintenance cartridge in the service zone with the cross wiper in a disengaged position. The pre-treatment cartridge is able to pass the cross wiper position without being wiped. With the printheads located in the spittoon, or above the web, one or more of the printheads may perform a spitting operation by firing fluid onto the spittoon or web. As shown in FIG. 4F, after the printheads have been serviced (i.e. by cross wiping and/or spitting), the carriage leaves the service zone (or enters the print zone from the maintenance cartridge) with the cross wiper in the disengaged position. Once the carriage moves away from the maintenance cartridge the cross wiper is engaged ready for the next servicing operation (as shown in FIG. 4A). The cross wiper may be engaged immediately or instantly once the last printhead in the carriage has passed the cross wiper position, where this can increase printing throughput. With the cross wiper in the engaged, ready position, the maintenance cartridge waits for the carriage to return for a subsequent pass or cleaning operation.

According to an example the maintenance cartridge may move along the y-axis to align the printheads with capping 490. The carriage may enter the service station or maintenance cartridge and register with the position of the capping. The maintenance cartridge may then move along the y-axis to bring the printheads above the spittoon or web. The movement of the maintenance cartridge along the y-axis performs a web wipe pass of the printheads. The printheads may spit on the web as the carriage moves out of the service zone (i.e. enters the print zone). The spit roller motor may engage with the cross wiper transmission to return the cross wiper to the engaged position, waiting for the carriage to come back in a subsequent print pass.

Figure 6:
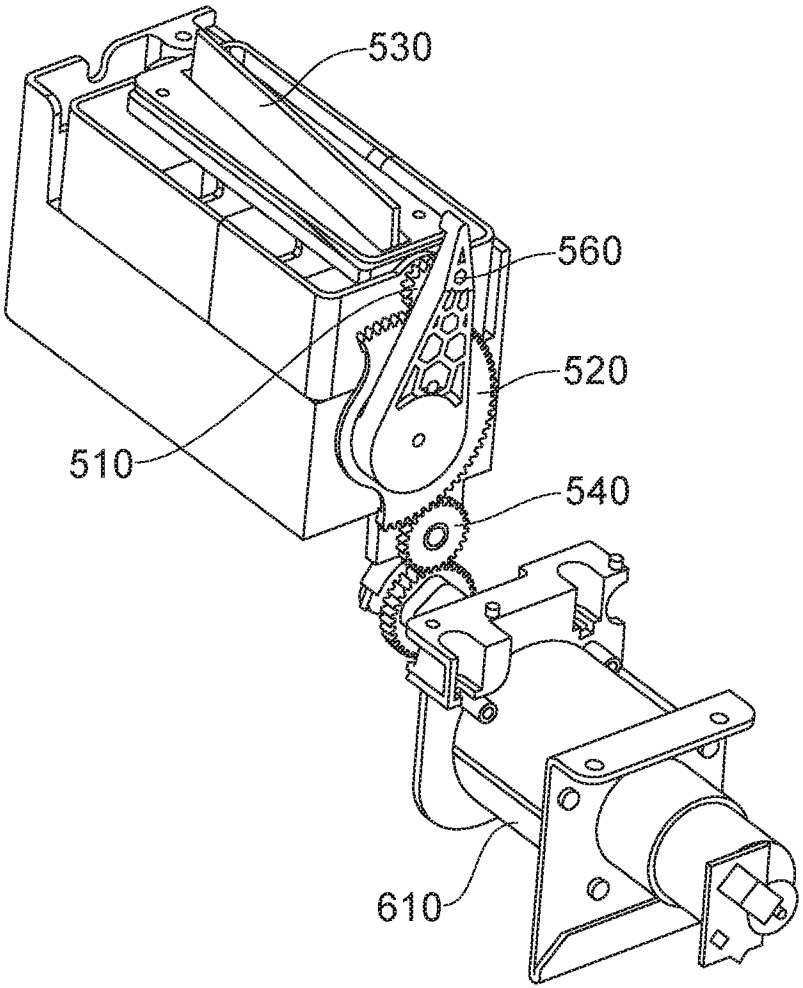
FIGS. 5-7 show an actuation mechanism for the cleaning mechanism according to an example.
Figure 5:
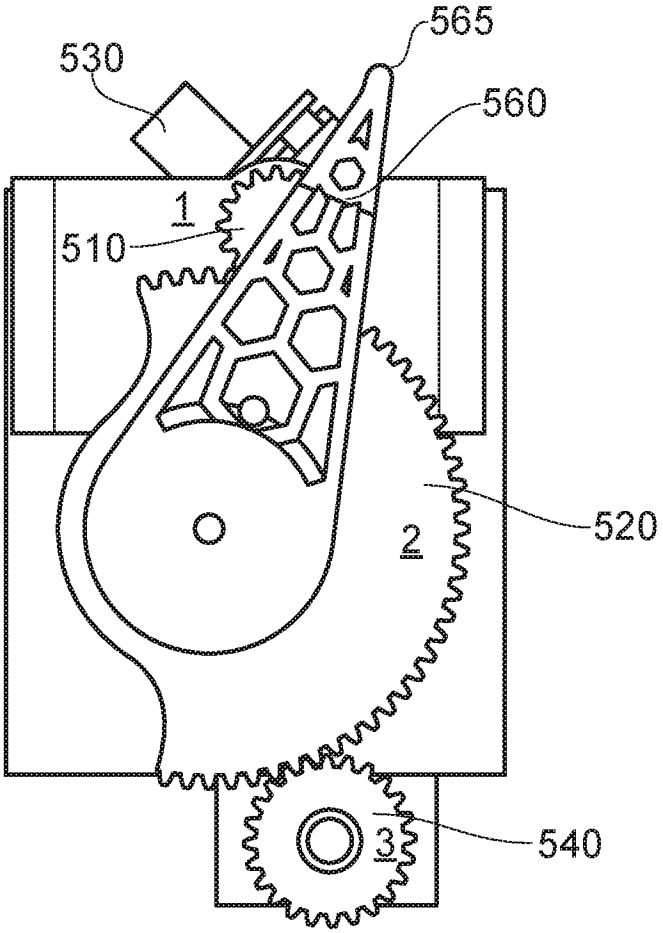

The printhead carriage movement can actuate the cleaning operation. FIGS. 5-7 show an actuation mechanism for the cleaning mechanism according to an example.

According to an example the cleaning mechanism comprises a cleaning structure or cross wiper 530 and an actuation mechanism. The actuation mechanism may comprise gears 510, 520, 540, and a lever 560 as shown in FIG. 5. The gears and lever move the cross wiper between the engaged and disengaged positions, depending on where the carriage is located. A corresponding triggering element 565 on the lever can interact with a similar triggering element on the carriage. When the carriage passes the triggering element on the lever of the maintenance cartridge the actuation mechanism is triggered to operate, causing the cross wiper to engage or disengage. For example, the disengaged configuration may be activated by a first triggering element associated to the carriage interacting with a corresponding triggering element on the maintenance cartridge subsequent to a cleaning operation. The engaged configuration may be activated by a second triggering element (e.g. a motor) when the carriage moves away from a service zone.

The actuation mechanism of the maintenance cartridge may comprise a triggering element by way of a lever and gears. The gears may be configured to move the cleaning structure to the engaged configuration when the carriage moves away from the service zone. According to an example, the actuation mechanism comprises at least three gears, the first gear being connected to the cleaning structure, the second gear being connected to the lever, and the third gear configured for connection to an external motor. The lever may be configured to move the cleaning structure into the disengaged position once a proportion or part of the carriage has passed into the service zone from a print zone. For example, as the carriage enters the service zone a first part of the carriage will pass into the service zone before the printhead with the triggering element reaches the cross wiper. According to an example, the first triggering element or projection may be provided on a printhead such that once the printhead nozzles are outside a contact zone with the cross wiper and/or web wiper and/or spittoon, the first triggering element causes the wiper to disengage as the carriage moves away from the service zone.

According to an example, the actuation mechanism or cross wiper mechanism of the maintenance cartridge comprises three gears. The first gear 510 can move with the cross wiper 530. The second gear 520 comprises a lever 560 configured to come into contact with a first triggering element in the carriage, where this contact is used to activate the disengage movement for the cross wiper. The third gear 540 is connectable to a transmission or drive motor in the service station or maintenance cartridge. When the engage movement is activated by a triggering element, for example a further projection located elsewhere on the carriage, the second triggering element (i.e. motor) turns the gear 540 to engage the cross wiper.

According to an example, the third gear 540 is connected to a web or spit roller motor transmission 610 as shown in FIG. 6. In this configuration, when the carriage moves away from the maintenance cartridge the cross wiper (in the disengaged configuration) is triggered to engage. According to an example, the motor that moves the maintenance cartridge in the y-direction may simultaneously advance the web or spittoon into which the printheads may have performed a spitting operation. Alternatively, the web may be advanced by a separate web motor. This provides a fresh, clean section of web for subsequent spitting operations. This configuration provides a more efficient and compact maintenance cartridge that is able to perform the function of both engaging the cross wiper and advancing the web using the same second triggering element at the same time.

According to an example, when spit rollers are provided, the motor that engages the cross wiper may be the same motor that rotates the spit rollers. For this, the maintenance cartridge may move along the y-direction to align the cross wiper or the spit rollers with the spit roller motor.

According to an example, a first triggering element within the carriage may comprise a mechanical trigger or projection to engage and/or disengage the actuation mechanism as the carriage moves.

Figure 7C:
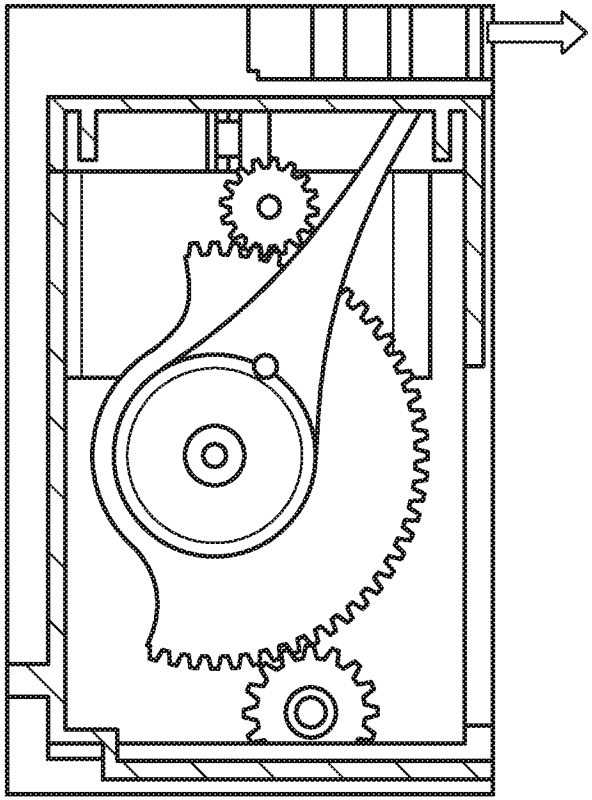
Figure 7B:
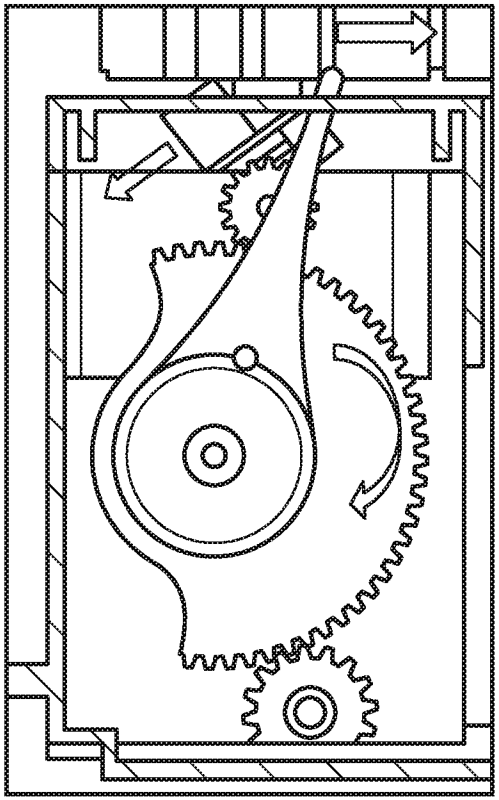
Figure 7A:
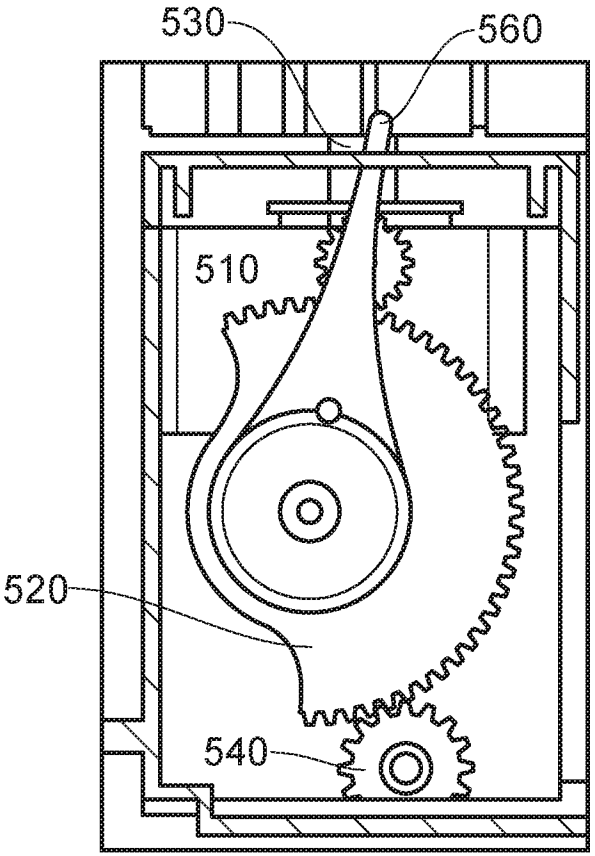

FIGS. 7A-C show an actuation mechanism for the cleaning mechanism according to an example. According to an example, the actuation mechanism is connected to the cleaning structure. When the carriage moves into the service zone the wiper wipes the printheads. Before the pre-treatment printhead passes the wiper, the mechanism retracts the wiper so as not to wipe the pre-treatment printhead. The cleaning structure may be disengaged into the disengaged configuration before some of the printheads, e.g., an optimizer or pre-treatment printhead, has reached the cleaning structure. A corresponding first triggering element on the maintenance cartridge interacts with the lever to spring the wiper out of the way. Then, when the carriage has moved out of the service zone (back into the print zone) the wiper is once again engaged by the gears, so that the wiper is ready to clean the printheads the next time the carriage enters the service zone. This configuration allows for a simpler, more compact printer.

According to an example, a torsion spring can be provided to engage or disengage the cross wiper. When the cross wiper is in the engaged position, as shown in FIG. 7A, the disengage movement can be triggered by the carriage movement with a feature included in an under-carriage-protector.

The disengage movement of the cross wiper may be activated with the carriage movement due to the first triggering element feature in the under-carriage-protector, as shown in FIG. 7B. The triggering element may be placed to help ensure that the cross wiper disengage (i.e. retract or "get down") exactly in the moment that the overcoat printhead or last printhead traveling along the x-axis into the maintenance cartridge has been cross wiped and the pre-treatment or optimizer printhead has not yet reached the cross wiper.

When the cross wiper is in the disengaged position, as shown in FIG. 7C, and the carriage moves away from the service station, a second triggering element can return the cross wiper to the engaged position. For example, the second triggering element may be a motor allocated in the service station and arranged to engage with the third gear 540.

According to an example there is provided a rendering apparatus to perform a cleaning operation of a set of printheads within a carriage comprising the maintenance cartridge described above. For example, the maintenance cartridge may comprise a cleaning structure connected to an actuation mechanism. The actuation mechanism may be configured to position the cleaning structure between an engaged configuration and a disengaged configuration. The disengaged configuration may be activated by a first triggering element associated to the carriage interacting with a corresponding triggering element on the maintenance carriage subsequent to a cleaning operation. The engaged configuration may be activated by a second triggering element when the carriage moves away from a service zone. According to an example there is provided a printing system comprising printhead servicing. The printhead servicing may be achieved using cross wiping with a cleaning mechanism. The cleaning mechanism may be synchronized with carriage movement such that the cross wiper touches all the printheads except the pre-treatment cartridge.

According to an example, cleaning operations using a web helps to prevent crusting in products comprising latex fluids. The printhead servicing described allows a configuration of the printhead cleaner that minimizes the impact in printer width. It allows a configuration of the printhead cleaner that minimizes the printhead cleaner movements, so printhead cleaning operations have the minimum effect on throughput. This solution enables the possibility of using a cross wiper to avoid the 'streakiness' defect whilst minimizing the impact on throughput and printer dimensions.

While the method, apparatus and related aspects have been described with reference to certain examples, various modifications, changes, omissions, and substitutions can be made without departing from the spirit of the present disclosure. In particular, a feature or block from one example may be combined with or substituted by a feature/block of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A maintenance apparatus to, while in a service zone, perform a cleaning operation of a set of printheads within a carriage, comprising:

a cleaning structure; and an actuation mechanism, the actuation mechanism to position the cleaning structure between an engaged configuration and a disengaged configuration, the disengaged configuration being activated by a first triggering element associated to the carriage interacting with the actuation mechanism subsequent to a cleaning operation, and the engaged configuration being activated by a second triggering element as the carriage moves away from the service zone.

2. A maintenance apparatus according to claim 1, wherein the first triggering element is a projection on the printhead.

3. A maintenance apparatus according to claim 1, wherein the second triggering element is a motor within the maintenance apparatus.

4. A maintenance apparatus according to claim 1, wherein the cleaning structure is a cross wiper comprising an elastomer.

5. A maintenance apparatus according to claim 1, wherein the first triggering element is a projection on a lower surface of the carriage.

6. A maintenance apparatus according to claim 1, further comprising a web wiper and/or a spittoon.

7. A maintenance apparatus according to claim 6, wherein the spittoon is a spit roller.

8. A maintenance apparatus according to claim 1, wherein the carriage comprises a first set of printheads and a second set of printheads, wherein the cleaning structure is positioned into the disengaged configuration before the second set of printheads has reached the cleaning structure.

9. A maintenance apparatus according to claim 1, wherein the actuation mechanism comprises gears and a lever.

10. A maintenance apparatus according to claim 9, wherein the gears are configured to move the cleaning structure to the engaged configuration when the carriage moves away from the service zone.

11. A maintenance apparatus according to claim 9, wherein the actuation mechanism comprises at least three gears, the first gear being connected to the cleaning structure, the second gear being connected to the lever, and the third gear configured for connection to a motor within the maintenance cartridge.

12. A maintenance apparatus according to claim 11, wherein the motor within the maintenance cartridge connected to the third gear is a web advancement motor.

13. A maintenance apparatus according to claim 9, wherein the lever is configured to move the cleaning structure into the disengaged position once at least part of the carriage has passed into the service zone from a print zone.

14. A rendering apparatus to, while in a service zone, perform a cleaning operation of a set of printheads within a carriage, comprising:

a maintenance cartridge comprising a cleaning structure and an actuation mechanism, the actuation mechanism to position the cleaning structure between an engaged configuration and a disengaged configuration, the disengaged configuration being activated by a first triggering element associated to the carriage interacting with the actuation mechanism subsequent to a cleaning operation, and the engaged configuration being activated by a second triggering element as the carriage moves away from the service zone.

15. A rendering apparatus according to claim 14, wherein the first triggering element is a projection on a printhead and the second triggering element is a motor within the maintenance apparatus.

* * * * *